US009740173B2

(12) United States Patent
Villar

(10) Patent No.: US 9,740,173 B2
(45) Date of Patent: Aug. 22, 2017

(54) SHOCKPROOF SYSTEM WITH SECURE MOUNTING

(71) Applicant: ETA SA MANUFACTURE HORLOGERE SUISSE, Grenchen (CH)

(72) Inventor: Ivan Villar, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/894,792

(22) PCT Filed: Jun. 9, 2014

(86) PCT No.: PCT/EP2014/061938
§ 371 (c)(1),
(2) Date: Nov. 30, 2015

(87) PCT Pub. No.: WO2014/202418
PCT Pub. Date: Dec. 24, 2014

(65) Prior Publication Data

US 2016/0109854 A1 Apr. 21, 2016

(30) Foreign Application Priority Data

Jun. 21, 2013 (EP) ..... 13173255

(51) Int. Cl.
*G04B 31/02* (2006.01)
*G04B 31/04* (2006.01)

(52) U.S. Cl.
CPC ..... *G04B 31/04* (2013.01); *G04B 31/02* (2013.01)

(58) Field of Classification Search
CPC .. G04B 31/00; G04B 31/008; G04B 31/0082; G04B 31/02; G04B 31/04
See application file for complete search history.

(56) References Cited

U.S. PATENT DOCUMENTS 3,712,051 A * 1/1973 Romang ..... G04B 31/04 368/326
7,234,859 B2 * 6/2007 Kohler ..... G04B 31/04 368/326

(Continued)

FOREIGN PATENT DOCUMENTS

CH 369 336 A 5/1963
CH 705 075 A2 12/2012

(Continued)

OTHER PUBLICATIONS

CH705075 DetDesc—Machine Translation—retrieved from the Internet Dec. 27, 2016.*

(Continued)

*Primary Examiner* — Vit W Miska
(74) *Attorney, Agent, or Firm* — Oblon, McClelland, Maier & Neustadt, L.L.P.

(57) ABSTRACT

A shock absorber device for an arbour of a timepiece element including a support including a base cup surmounted by a peripheral rim delimited, opposite the cup, by an upper surface and including an outer wall, the cup and the rim defining together a recess. The device further includes at least one pivot module extending along an axis, the at least one pivot module being arranged in the recess and configured to cooperate with the arbour and a cap formed by a hollow part fixed to the support on the peripheral rim, the cap including an inner wall on which at least one groove is arranged so that an elastic mechanism can be placed therein.

31 Claims, 4 Drawing Sheets

(56) References Cited

U.S. PATENT DOCUMENTS

| | | | | |
|---|---|---|---|---|
| 8,777,481 | B2 * | 7/2014 | Conus | G04B 31/04 368/324 |
| 2006/0215499 | A1 * | 9/2006 | Kohler | G04B 31/04 368/324 |
| 2010/0188941 | A1 | 7/2010 | Fujieda | |

FOREIGN PATENT DOCUMENTS

| | | | |
|---|---|---|---|
| DE | 14 47 385 | A1 | 11/1968 |
| DE | 19 17 064 | A1 | 10/1969 |
| FR | 2 336 588 | A1 | 7/1977 |

OTHER PUBLICATIONS

International Search Report Issued Mar. 19, 2015 in PCT/EP14/61938 Filed Jun. 9, 2014.

* cited by examiner

SHOCKPROOF SYSTEM WITH SECURE MOUNTING

CROSS-REFERENCE TO RELATED APPLICATIONS

This is a National phase Application in the United States of International patent Application PCT/EP2014/061938 filed Jun. 9, 2014 which claims priority on European patent Application 13173255.4 filed Jun. 21, 2013. The entire disclosure of the above patent application are hereby incorporated herein by reference.

The present invention concerns a shockproof system for an arbour of a timepiece wheel set. The arbour includes a pivot-shank including a support, said support being provided with a recess for receiving a pivot system into which the pivot-shank is inserted. The shockproof system further includes elastic means arranged to exert at least an axial force on said pivot system.

The technical field of the invention is the technical field of fine mechanics.

BACKGROUND OF THE INVENTION

The present invention concerns bearings for timepieces and more specifically of the shock absorber type. Designers of mechanical watches have for a long time devised numerous devices enabling an arbour to absorb the energy resulting from a shock, particularly a lateral shock, by bearing against a wall of the hole in the base block through which the arbour passes, while allowing a temporary movement of the pivot-shank before it is returned to its rest position under the action of a spring.

FIGS. 1 and 2 illustrate a device, called a double inverted cone device, which is currently used in timepieces found on the market.

A support 1, the base of which comprises a hole 2 for the balance staff 3 ending in pivot-shank 3*a*, allows a setting 20 to be positioned, in which a pierced stone 4, traversed by pivot-shank 3*a*, and an endstone 5 are fixedly secured. Setting 20 is held in a recess 6 of support 1 by a spring 10 which, in this example, includes radial extensions 9 compressing endstone 5. Support 1 is a part of revolution including a circular rim 11. This rim 11 is interrupted at two diametrically opposite places by an aperture 12 so as to create two semi-circular rims 11*a*, 11*b*. Aperture 12 is arranged partly in the two semi-circular rims 11*a*, 11*b* so as to form two return portions. Setting 20 is held in a recess 6 of support 1 by elastic means such as a spring 10 which, in this example, includes radial extensions 9 compressing endstone 5. Spring 10 is of the axial type and is lyre-shaped so as to rest on the return portions of semi-circular rims 11*a*, 11*b*. Recess 6 includes two shoulders 7, 7*a* in the form of inverted cones on which complementary shoulders 8, 8*a* of setting 20 rest. Said shoulders must be made with a high level of precision. In the event of an axial shock, pierced jewel 4, endstone 5 and the balance staff move and spring 10 acts alone to return balance staff 3 to its initial position. Spring 10 is sized to have a travel limit so that, beyond the limit, the balance staff 3 comes into contact with stop members 14 allowing staff 3 to absorb the shock, which pivot-shanks 3*a* of staff 3 cannot do without breaking. In the event of a lateral shock, i.e. when the end of the pivot-shank unbalances setting 20 out of its resting plane, spring 10 cooperates with the complementary inclined planes 7, 7*a*; 8, 8*a* to re-centre setting 20. These bearings have been sold, for example, under the trademark Incabloc®. These springs may be made of phynox or brass and are manufactured by conventional cutting means.

One drawback of these shock absorber systems is that they are not easy to mount. Indeed, some parts like support 1 and spring 10 must be oriented and manipulated in a certain manner during the mounting operation to enable assembly to occur. Thus, the assembly of the shock absorber system begins with taking a support and then a setting with its jewels. The setting is placed in the recess in the support. Next, a lyre-shaped axial spring is provided. This is manipulated so that it can rest underneath the return portions of semi-circular rims 11*a*, 11*b* of the support.

Consequently, a particular manipulation is required to set the spring in place and secure it to the support. As a result, the shock absorber systems must be assembled partly manually since a robot cannot perform such a complex manipulation.

Further, manual assembly is preferred since a human being is capable of instantaneously understanding how the parts of the shock absorber system must be oriented in relation to each other. Indeed, regardless of the shape of the parts, a person is capable of instantly knowing how to manipulate the parts in order to assemble them. Even if a robot is able to differentiate the orientation of one part with respect to another, this requires a more complex and therefore more expensive robot and also requires more time. Consequently, this adversely affects production output.

Thus, total automation of the assembly process is not possible and the method of assembling shock absorber systems is therefore more expensive.

Further, automation of the mounting process may result in the presence of vibrations which propagate in the shock absorber system. These vibrations may cause the parts of the shock absorber system to move so that they are no longer perfectly centred with respect to each other. This potential loss of centring may cause other damage. Indeed, during the mounting of a first part on a second part, a third part required to be placed between the first part and the second part may become pressed between said first and second parts and thus damaged.

SUMMARY OF THE INVENTION

It is an object of the invention to overcome the drawbacks of the prior art by proposing to provide a shock absorber system whose assembly process is simple, secure and easy to automate.

To this end, the invention concerns a shock absorber device for an arbour of a timepiece element including a support comprising a base cup surmounted by a peripheral rim which is delimited, opposite said cup, by an upper surface and including an outer wall, said cup and said rim defining together a recess, the device further including at least one pivot module, said at least one pivot module being arranged in said recess and able to cooperate with said arbour, extending along a central axis C, said device further including a cap formed by a hollow part secured to the support on said peripheral rim and including an inner wall, wherein at least one groove is arranged on the inner wall so that elastic means can be placed therein such that the elastic means are held axially at the top and the bottom by said cap, the elastic means being arranged to exert a face on the pivot module.

A first advantage of the present invention is that it combines automation of the assembly process with the security of having elastic means that are always perfectly positioned. Indeed, the device according to the present invention has the advantage of having the elastic means pre-positioned with respect to the cap which retains said elastic means. Consequently, there is no risk of the elastic means being improperly positioned or damaged during the mounting of said shock absorber device.

Advantageous embodiments of the invention form the subject of the dependent claims.

In a first embodiment, said elastic means include a spring ring including at least two arms extending towards the axial centre of said spring ring to press said pivot module into the recess in the support.

In a second embodiment, the at least two arms are diametrically opposite.

In a third embodiment, said elastic means include a spring ring including inner radial extensions arranged between annular portions, said inner radial extensions being formed by the band forming the ring which is bent towards the interior of the ring.

In another embodiment, the hollow part is cylindrical and has a first diameter for securing said annular portion to the peripheral rim of the support and a second diameter forming a bearing region for the elastic means when said elastic means are deformed during a shock.

In another embodiment, said inner radial extensions are regularly distributed.

In another embodiment, the spring ring further includes two catches extending in a direction away from the axial centre of said spring ring.

In another embodiment, the spring ring further includes at least two catches extending in a direction away from the axial centre of said spring ring, the at least two catches being located on annular portions.

In another embodiment, the cap is screwed to said peripheral rim.

In another embodiment, the cap is non releasable secured to said peripheral rim.

In another embodiment, the cap is force-fitted to said peripheral rim.

In another embodiment, the cap is bonded to said peripheral rim.

In another embodiment, the cap is welded to said peripheral rim.

BRIEF DESCRIPTION OF THE DRAWINGS

The objects, advantages and features of the shockproof or shock absorber system according to the present invention will appear more clearly in the following detailed description of at least one embodiment of the invention, given solely by way of non-limiting example and illustrated by the annexed drawings, in which.

DETAILED DESCRIPTION OF THE INVENTION

The present invention proceeds from the general inventive idea which consists in providing a shock absorber device that cannot be disassembled or a simple shockproof device, which is easy to mount and offers fewer risks of problems during mounting. This shock absorber system is arranged to be mounted on a main plate and/or at least one bar of a timepiece movement. The timepiece movement is placed in a timepiece including a middle part closed by a back cover and a crystal.

Figure 1:
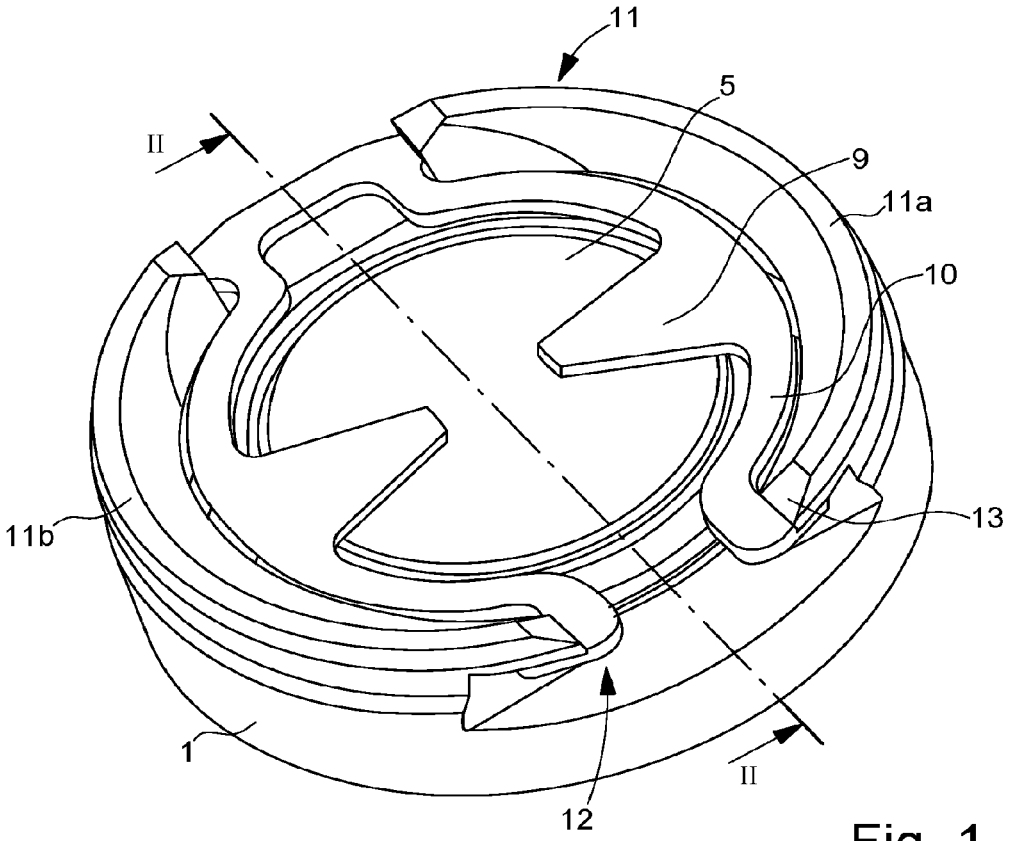
Fig. 1 (Prior Art)
FIGS. 1 and 2, already cited, are schematic views of a shock absorber system for a timepiece according to the prior art.
Figure 2:
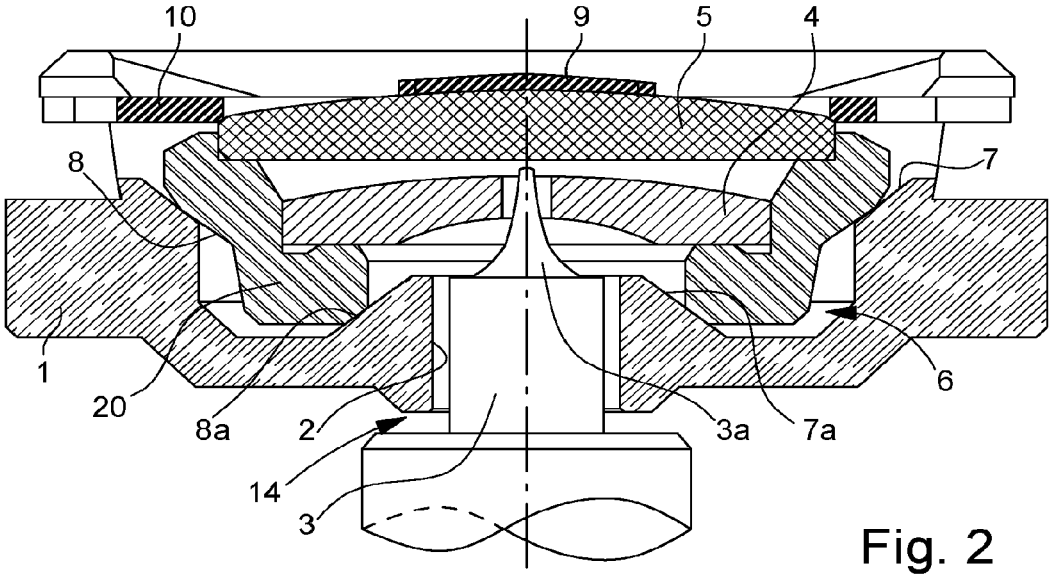
Fig. 2 (Prior Art)
Figure 3:
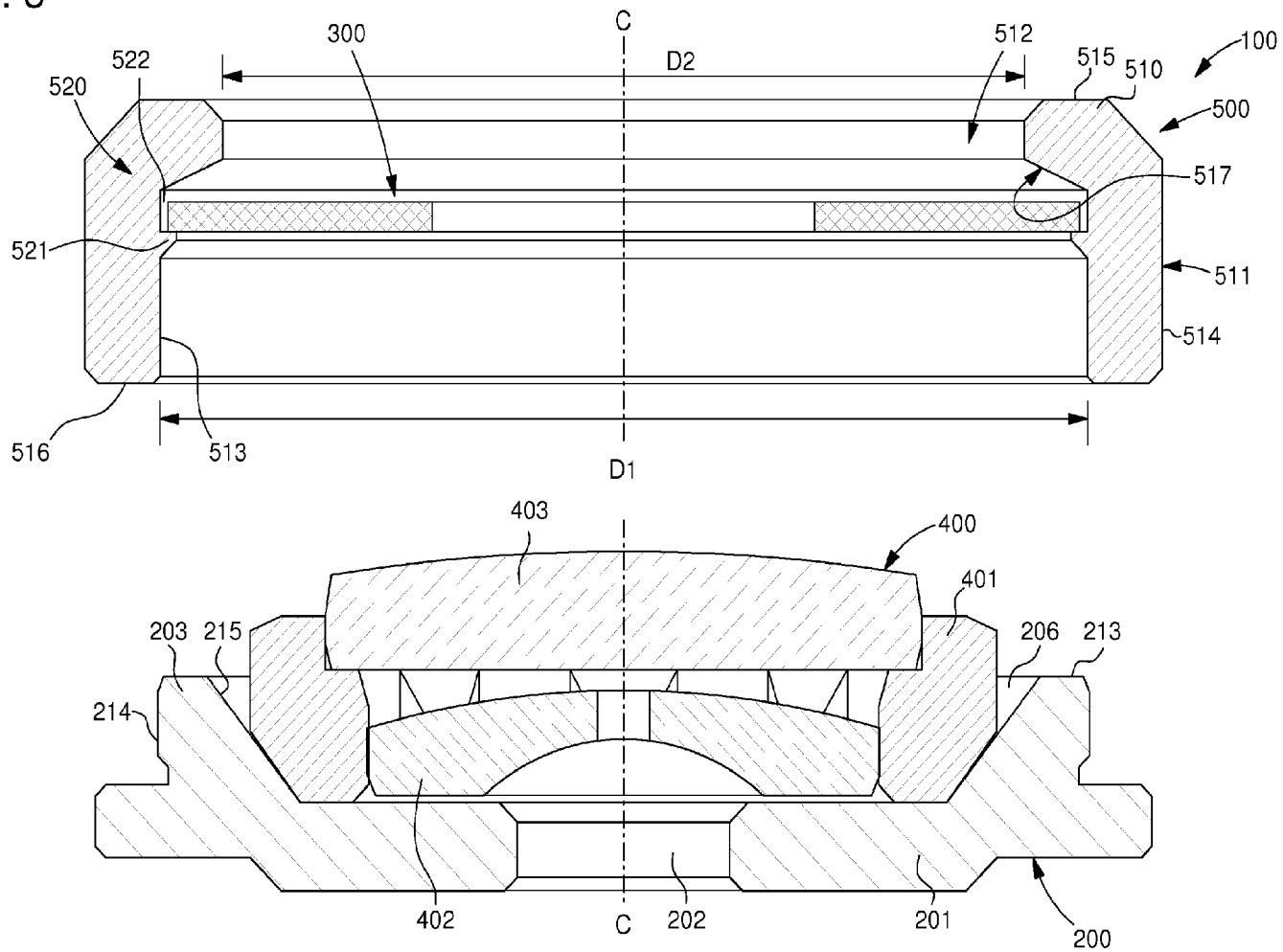
FIGS. 3 and 4 are schematic views of a shock absorber system for a timepiece according to the invention when it is dismounted and mounted.
Figure 4:
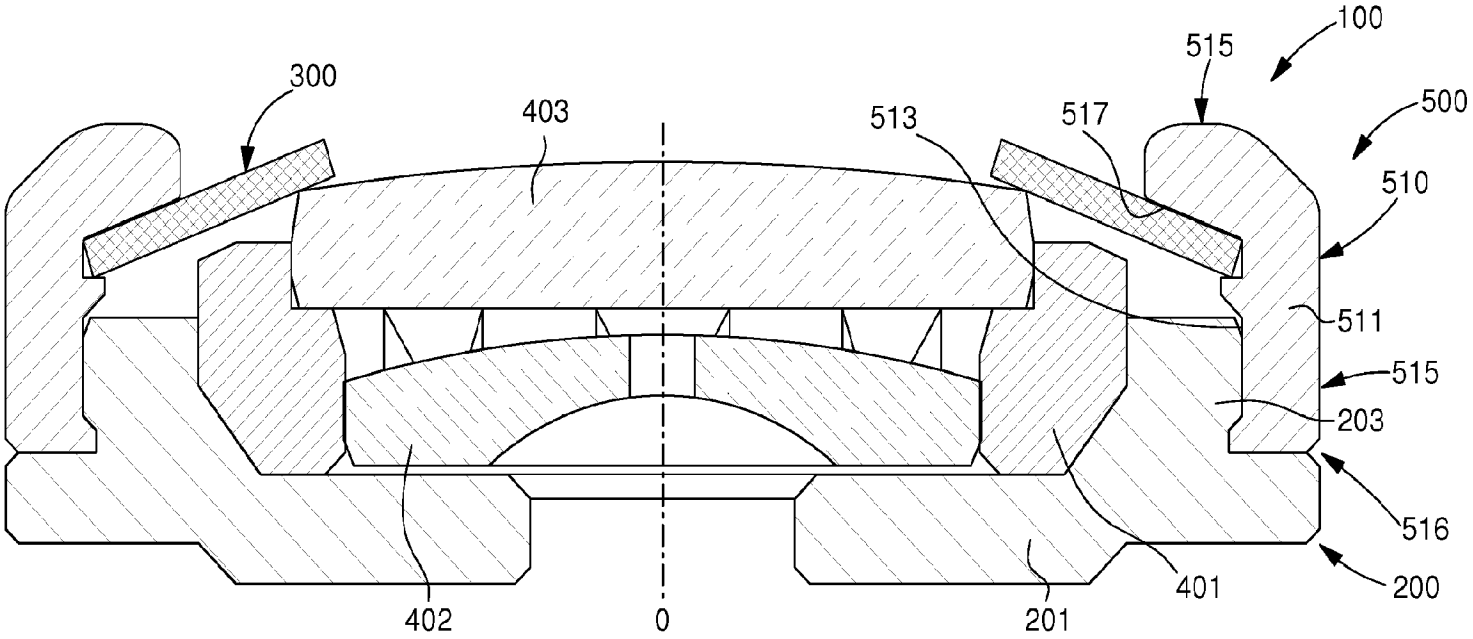

FIGS. 3 and 4 show a shock absorber device or bearing 100 or shockproof system according to a first embodiment. This shock absorber device or shockproof system 100 is mounted in a base element of a timepiece movement. In particular, the main plate or the bars of the movement are the base element in which the shockproof system 100 according to the invention is placed. This shockproof system 100 includes a support 200. Support 200 takes the form of a cup 201 provided with a hole 202 surmounted by a peripheral rim 203 delimited, opposite said cup, by an upper surface 213. This peripheral rim 203 also has an outer wall 214 and an inner wall 215. Rim 203 and base cup 201 define a recess 206, into which a pivot module 400 is inserted. A conventional pivot module 400 includes a setting 401, i.e. a part having a central circular orifice, an outer wall and an inner wall. A pierced jewel 402, whose diameter corresponds to that of the central orifice, is inserted into the central orifice. The inner wall includes a shoulder enabling an endstone 403 to be secured. Pivot module 400 is then placed inside recess 206 of support 200 and cooperates with a pivot shank of an arbour.

Shockproof system 100 further includes elastic means 300 which are arranged to cooperate with pivot module 400. This allows shocks to be absorbed and pivot module 400 to be returned to its rest position when the stresses exerted following shocks die down. Elastic means 300 are fixed to support 200. Preferably, elastic means 300 are also placed on pivot module 400. Shockproof system 100 is then inserted into an orifice in the main plate or in one of the bars of the movement.

Fixing means 500 include an additional part 510 used for fixing elastic means 300 to support 200. This additional part 510 takes the form of a cap 510 which is fixed to support 200. Cap 510 is devised so that when it is fixed to support 200, elastic means 300 exert a force on pivot module 400. This force allows pivot module 400 to be immobile without, however, hindering the movement thereof during a shock. Indeed, during a shock, the arbour abuts pivot module 400 which moves and elastically deforms elastic means 300.

Cap 510 takes the form of a part 511 having an aperture 512. This part 511 has an inner wall 513 and an outer wall 514 and an upper end 515 and a lower end 516. The aperture of element 511 has a first inner dimension so as to cooperate with peripheral rim 203. Indeed, part 511 is fixed via lower end 515 to peripheral rim 203. Thus, support 20, rim 203 and cap 510 may be square or have any other possible shape, provided that element 511 can be fixed to peripheral rim 203.

Preferably, cap 510 takes the form of a cylindrical annular part 511 extending along a central axis (C) and having an aperture 512. This cylindrical annular part 511 has an inner wall 513 and an outer wall 514 in addition to an upper end 515 and a lower end 516. The aperture of cylindrical annular part 511 has a first inner diameter D1 so as to cooperate with peripheral rim 203. Indeed, each cylindrical annular part 511 is inserted via lower end 515 in peripheral rim 203. The securing of cylindrical annular part 511 to peripheral rim 203 is achieved by forced insertion, by screwing, by welding or by adhesive bonding. In the case wherein the securing of cylindrical annular part 511 to peripheral rim 203 is achieved by forced inserting, by screwing, by welding or by adhesive bonding, it will be understood that the shock absorber device is non-removable.

A retaining region 520 is arranged on inner wall 513. This retaining region 520 may take the form of a groove 520*a* (not shown) so that elastic means 300 can be inserted therein. This enables elastic means 300 to be held axially by the top and by the bottom and prevents elastic means 300 being clamped between cap 510 and support 200 during the mounting of shockproof system 100. The inner wall may have a different shape from outer wall 514, for example, inner wall 513 may be circular and outer wall 514 may be square. Further, it is possible to envisage inner wall 513 having a first shape at upper end 515 and a second shape at lower end 516. Thus, it is possible for inner wall 513 to have, at the upper end 515 thereof, a shape suited for the region retaining elastic means 300 and, at lower end 516 thereof, a shape suited for securing said cap 510 to support 200 via peripheral rim 203.

In a first advantageous variant illustrated in FIG. 3, upper end 515 of cylindrical annular element 511 has a second inner diameter D2 that is smaller than the first inner diameter D1. This difference in diameter allows the creation of a bearing region 517 for elastic means 300. Retaining region 520 is arranged on this upper end of cylindrical annular part 511 having a second inner diameter D2.

This retaining region 520 includes a bump 521 extending from inner wall 513 of cylindrical annular part 511. This bump 521 forms, with bearing region 517, a groove 522 into which elastic means 300 are inserted. Elastic means 300 are supported on bump 521. When there is a shock to the timepiece, the arbour abuts shockproof system 100 so that pivot module 400 moves. Elastic means 300 are deformed and bear on bearing region 517.

Elastic means 300 take, for example, the form of a spring ring 301. This spring ring 301 is of the flat type, i.e. it is formed of a strip or band, i.e. having greater width than thickness. The strip or band forming spring ring 301 is metallic and circular extending along a central axis (C).

Figure 5:
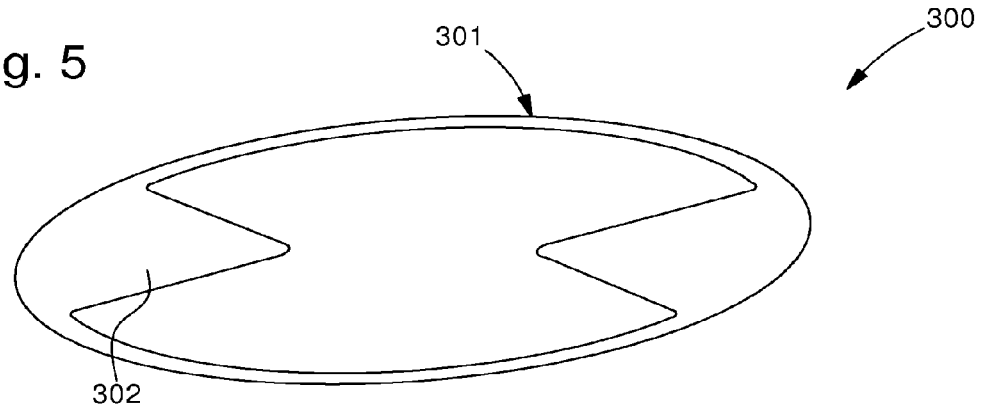
FIGS. 5 to 7 show different solutions for the elastic means of the timepiece shock absorber system according to the invention.

In a first embodiment of this spring ring 301 seen in FIG. 5, elastic means 300 take the form of a spring ring 301 which includes two arms 302 extending towards the axial centre of said spring ring 301. These arms 302 are diametrically opposite and are used to press said pivot module 400 into recess 206 of support 200.

Figure 6:
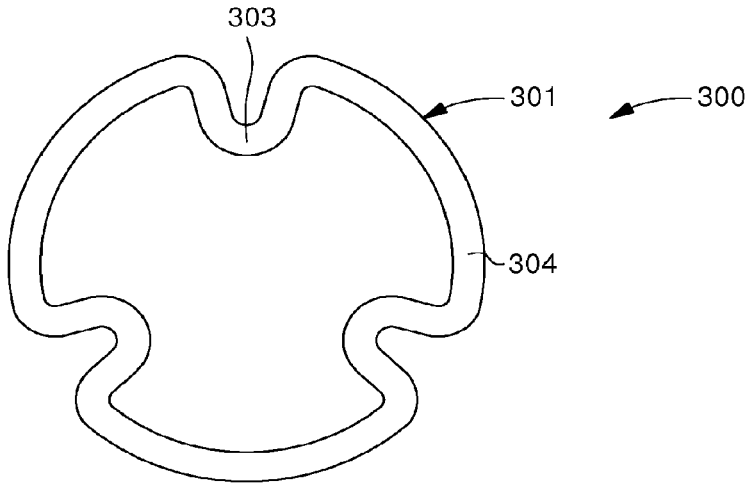

In a second embodiment of this spring ring 301 seen in FIG. 6, spring ring 301 includes inner radial extensions 303 arranged between annular parts 304. These inner radial extensions 303 are formed by the strip forming ring 301 which is bent towards the interior of ring 301. These inner radial extensions 303 are preferably regularly distributed over the periphery of flat ring 301 so that spring ring 301 can act homogeneously, as seen in FIG. 5. It is thus understood that spring ring 301 may be oriented in any manner with respect to support 200.

This spring ring 301 is then arranged to be inserted into groove 520*a*, 522 located on inner wall 513 of cap 510. More specifically, it is the annular parts 303 which are inserted into said groove 520*a*. This arrangement provides a spring ring 301 which is integral with cap 510, i.e. spring ring 301 is pre-assembled to said cap 510. Thus, the mounting of said cap 510 is simplified.

Groove 520*a*, 522 has dimensions such that, once installed, spring ring 301 can move slightly. This allows spring ring 301 to move and be perfectly centred when cap 510 is mounted on support 200. The vibrations that may be generated during the automatic assembly process thus have no effect.

Figure 7:
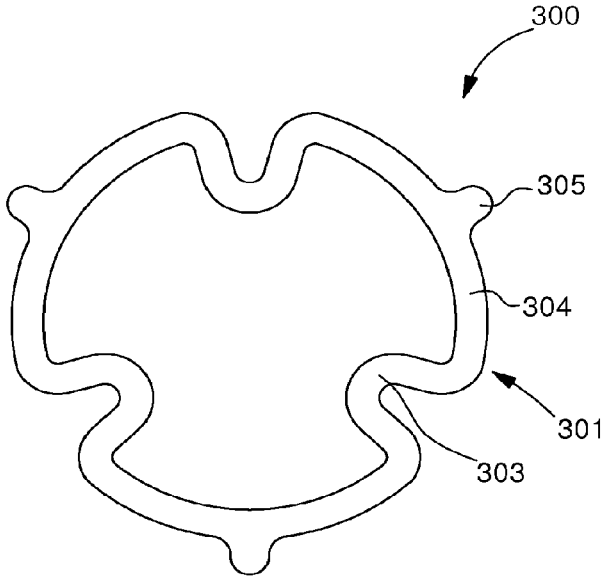

In a second variant, spring ring 301 has, on annular parts 303, catches 305 extending away from the axial centre of said spring ring 301, as seen in FIG. 7. These catches 305 are arranged to hold said spring ring 301 to said cap 510. Indeed, the dimensions of spring ring 301 and of cap 510 are calculated such that only catches 305 are inserted into groove 520*a*.

This arrangement has the advantage of limiting the effect of groove 520*a*, 522 on said spring ring 301. In fact, when spring ring 301 is placed in groove 520*a*, 522, the latter modifies the mechanical response in the event of stress since it exerts a stress on said spring ring, particularly on annular parts 303 of spring ring 301 described above. These annular parts 303 are active regions, i.e. they are involved in the elastic action of spring ring 301. The reactions of said spring ring 301 can thus be modified, which involves taking account thereof in the design of spring ring 301.

Owing to the presence of catches 305, the stress exerted on said spring ring 301 by groove 520*a*, 522 of cap 510 is confined only to catches 305. Consequently, since catches 305 are passive regions, i.e. with no effect on the behaviour of spring ring 301, the initial behaviour of spring ring 301 is not modified by its arrangement in groove 522, 520*a* of cap 510.

In a third variant, at least recess 206, pivot module 400 and elastic means 300 are made/arranged so that the various parts are angularly free with respect to each other. This means that the various parts making up shock absorber system 100, such as at least recess 206, pivot module 400 and elastic means 300, are assembled to each other without requiring any particular manipulation. Thus, no rotation or manipulation or torsion occurs during the mounting process. Preferably, at least recess 206, pivot module 400, cap 510 and elastic means 300 are parts of revolution, i.e. having a generally circular shape and extending along a central axis (C). This circular shape permits adaptation to any shape of support 200. Indeed, the circular shape, with no particular orientation, of recess 206, pivot module 400 and elastic means 300 means that it is possible to have a support 200 of any shape which, during mounting, will be positioned in any manner without this having any effect on the mounting process of shock absorber bearing 100. It is also possible for support 200, recess 206, pivot module 400 and elastic means 300 to be parts of revolution, i.e. having a circular shape.

This configuration of the parts of shock absorber bearing 100 according to the invention facilitates the assembly process. Indeed, if the parts have a particular orientation with respect to each other, they have to be manipulated so that assembly can occur. For example, in order to fit two triangular geometric figures one inside the other, each of the sides must be parallel, and positioning is therefore necessary.

By making support 200, recess 206, pivot module 400 and elastic means 300 so that the various parts are angularly free with respect to each other, it is possible, for example, to take pivot module 400 and place it in recess 206 with no prior manipulation.

It is possible to envisage making support 200 and the element of the movement in which shock absorber bearing 100 is placed as a single part, support 200 and the element of the movement are thus one-piece. It is thus understood that the base element has a recess arranged to form the pierced bottom of a hole and forming recess 206 inside which pivot module 400 is placed. It is also understood that this second variant may co-exist with the first variant. Indeed, since a bar or main plate may be of any shape, the arrangement of a mounting region ensures that the fixing means can be installed and therefore that pivot module 400 can be held in the recess.

It will be clear that various alterations and/or improvements and/or combinations evident to those skilled in the art may be made to the various embodiments of the invention set out above without departing from the scope of the invention defined by the annexed claims.

Indeed, it is possible for pivot module 400 to be formed of a single jewel or for the pierced jewel and endstone to be secured to each other. It is understood that the pierced jewel and the endstone may be driven one inside the other or be in a single piece. These possibilities allow the number of parts of the shock absorber bearing to be limited.

Further, it will be understood that any shape can be envisaged for the elastic means provided that they can be inserted into groove 520*a*, 522.

It is also possible to envisage that cap 510 includes two grooves 520*a*, 522 for the insertion of two spring rings 301.

The invention claimed is:

1. A shock absorber device for an arbour of a timepiece element, comprising:

a support including a base cup surmounted by a peripheral rim which is delimited, opposite the cup, by an upper surface and including an outer wall, the cup and the rim defining together a recess;

at least one pivot module being arranged in the recess and configured to cooperate with the arbour extending along a central axis; and a cap formed by a hollow part secured to the support on the peripheral rim and including an inner wall, wherein at least one groove is arranged on the inner wall so that an elastic mechanism is placeable therein such that the elastic mechanism is held axially at a top and bottom by the cap, the elastic mechanism being configured to exert a force on the pivot module, and the cap holds the elastic mechanism in an angularly free orientation about the central axis with respect to the support when the cap is secured to the support.

2. The shock absorber device according to claim 1, wherein the hollow part is cylindrical and has a first diameter to secure the part to the peripheral rim of the support and a second diameter forming a bearing region for the elastic mechanism when the elastic mechanism is deformed during a shock.

3. The shock absorber device according to claim 1, wherein the elastic mechanism includes a spring ring including at least two arms extending towards an axial center of the spring ring to press the pivot module into the recess of the support.

4. The shock absorber device according to claim 2, wherein the elastic mechanism includes a spring ring including at least two arms extending towards an axial center of the spring ring to press the pivot module into the recess of the support.

5. The shock absorber device according to claim 3, wherein the at least two arms are diametrically opposite.

6. The shock absorber device according to claim 4, wherein the at least two arms are diametrically opposite.

7. The shock absorber device according to claim 1, wherein the elastic mechanism includes a spring ring including inner radial extensions arranged between annular portions, the inner radial extensions being formed by a band forming the ring bent towards an interior of the ring.

8. The shock absorber device according to claim 2, wherein the elastic mechanism includes a spring ring including inner radial extensions arranged between annular portions, the inner radial extensions being formed by a band forming the ring bent towards an interior of the ring.

9. The shock absorber device according to claim 7, wherein the inner radial extensions are regularly distributed.

10. The shock absorber device according to claim 8, wherein the inner radial extensions are regularly distributed.

11. The shock absorber device according to claim 3, wherein the spring ring further includes at least two catches extending in a direction away from the axial center of the spring ring.

12. The shock absorber device according to claim 4, wherein the spring ring further includes at least two catches extending in a direction away from the axial center of the spring ring.

13. The shock absorber device according to claim 5, wherein the spring ring further includes at least two catches extending in a direction away from the axial center of the spring ring.

14. The shock absorber device according to claim 6, wherein the spring ring further includes at least two catches extending in a direction away from the axial center of the spring ring.

15. The shock absorber device according to claim 7, wherein the spring ring further includes at least two catches extending in a direction away from an axial center of the spring ring.

16. The shock absorber device according to claim 8, wherein the spring ring further includes at least two catches extending in a direction away from an axial center of the spring ring.

17. The shock absorber device according to claim 9, wherein the spring ring further includes at least two catches extending in a direction away from an axial center of the spring ring.

18. The shock absorber device according to claim 10, wherein the spring ring further includes at least two catches extending in a direction away from an axial center of the spring ring.

19. The shock absorber device according to claim 7, wherein the spring ring further includes at least two catches extending in a direction away from an axial center of the spring ring, the at least two catches being located on the annular portions.

20. The shock absorber device according to claim 8, wherein the spring ring further includes at least two catches extending in a direction away from an axial center of the spring ring, the at least two catches being located on the annular portions.

21. The shock absorber device according to claim 9, wherein the spring ring further includes at least two catches extending in a direction away from an axial center of the spring ring, the at least two catches being located on the annular portions.

22. The shock absorber device according to claim 10, wherein the spring ring further includes at least two catches extending in a direction away from an axial center of the spring ring, the at least two catches being located on the annular portions.

23. The shock absorber device according to claim 1 wherein the cap is screwed to the peripheral rim.

24. The shock absorber device according to claim 1, wherein the cap is non-releasably secured to the peripheral rim.

25. The shock absorber device according to claim 24, wherein the cap is force-fitted to the peripheral rim.

26. The shock absorber device according to claim 24, wherein the cap is bonded to the peripheral rim.

27. The shock absorber device according to claim 24, wherein the cap is welded to the peripheral rim.

28. The shock absorber device according to claim 1, wherein the at least one groove is dimensioned so that the elastic mechanism is moveable in the at least one groove to be centered when the cap is mounted on the support.

29. The shock absorber device according to claim 1, wherein the elastic mechanism acts homogeneously over a periphery of the elastic mechanism in exerting the force on the pivot module.

30. The shock absorber device according to claim 1, wherein the cap holds the elastic mechanism in an angularly free orientation about the central axis with respect to the pivot module when the cap is secured to the support.

31. The shock absorber device according to claim 1, wherein a top surface of the at least one groove is below a top surface of an endstone on which the elastic mechanism exerts force on.

* * * * *